US006135329A

United States Patent [19]

Stoneberg et al.

[11] Patent Number: 6,135,329

[45] Date of Patent: Oct. 24, 2000

[54] UNIVERSAL BASE PULL/PUSH-TWIST CLOSURE

[75] Inventors: Thomas C. Stoneberg, Buffalo Grove; Gary Berge, Crystal Lake; Tom L. Wilcox, Antioch, all of Ill.

[73] Assignee: Creative Packaging Corp., Buffalo Grove, Ill.

[21] Appl. No.: 09/415,797

[22] Filed: Oct. 11, 1999

[51] Int. Cl.[7] ..... B67D 3/00

[52] U.S. Cl. ..... 222/521

[58] Field of Search ..... 222/519, 520, 222/521, 522, 523, 524, 525

[56] References Cited

U.S. PATENT DOCUMENTS

| | | | |
|---|---|---|---|
| D. 278,311 | 4/1985 | Brown et al. . | |
| D. 306,701 | 3/1990 | Beck . | |
| D. 319,588 | 9/1991 | Beck . | |
| D. 323,461 | 1/1992 | Beck . | |
| D. 323,462 | 1/1992 | Beck . | |
| D. 324,175 | 2/1992 | Beck . | |
| D. 358,295 | 5/1995 | Moench . | |
| D. 398,851 | 9/1998 | Gaiser et al. . | |
| 3,263,851 | 8/1966 | Grimsley | 222/521 |
| 3,326,402 | 6/1967 | Randazzo . | |
| 3,599,845 | 8/1971 | Miller | 222/521 X |
| 4,383,623 | 5/1983 | Page, III . | |
| 4,424,918 | 1/1984 | Stull . | |
| 4,967,941 | 11/1990 | Beck . | |
| 5,145,094 | 9/1992 | Perlmutter . | |
| 5,255,823 | 10/1993 | Tichy et al. | 222/522 X |
| 5,328,063 | 7/1994 | Beck et al. . | |
| 5,429,282 | 7/1995 | Stebick . | |
| 5,456,374 | 10/1995 | Beck . | |
| 5,465,876 | 11/1995 | Crisci . | |
| 5,501,377 | 3/1996 | Dubach . | |
| 5,657,906 | 8/1997 | Rapchak et al. . | |
| 5,662,247 | 9/1997 | Rapchak et al. . | |
| 5,772,076 | 6/1998 | Juk et al. | 222/521 X |
| 5,829,611 | 11/1998 | Beck . | |
| 6,029,855 | 2/2000 | Adams | 222/525 X |

*Primary Examiner*—Kevin Shaver
*Assistant Examiner*—John Bastianelli
*Attorney, Agent, or Firm*—Silverman, Cass & Singer, Ltd.

[57] ABSTRACT

A dispensing closure for a container, the closure including a universal base for use with either a twist operational cap or a cap which is operational on the same base by pull/push operation. The universal base includes helical grooved channels to receive drive threads formed on the inner facing surface of a twist operational cap. The helical grooved channels do not interfere with operation of a pull/push cap when such cap is employed, as an alternative to a twist cap, for use on the same universal base.

8 Claims, 2 Drawing Sheets

FIG. 3
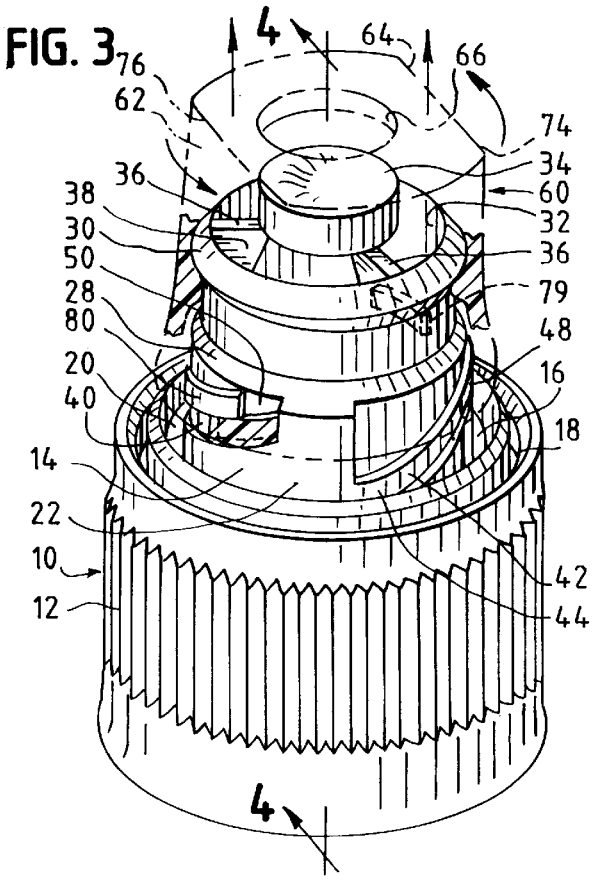
FIG. 4
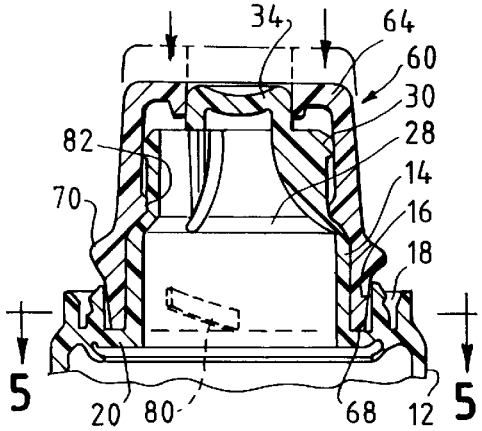
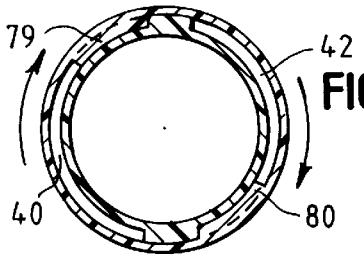
FIG. 5
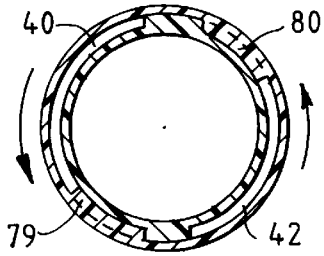
FIG. 6
FIG. 7
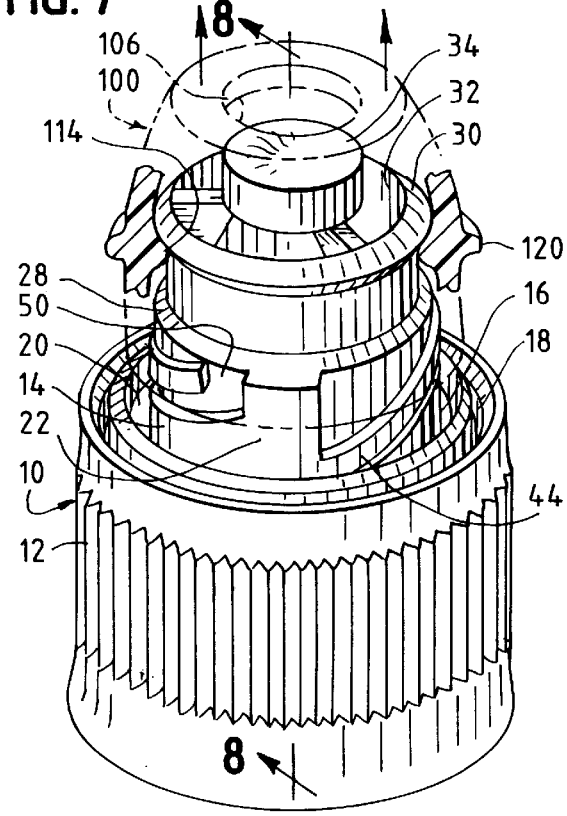
FIG. 8
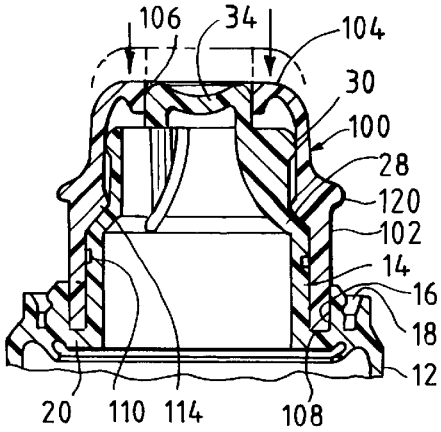

UNIVERSAL BASE PULL/PUSH-TWIST CLOSURE

BACKGROUND OF THE INVENTION

1. Field of the Invention

This invention relates generally to dispensing closures for containers, and more particularly, to such closures in which a universal base is usable interchangeably with either a twist cap or a pull/push cap to complete the closure.

2. Description of the Prior Art

Twist top or pull/push closures are known in which a cap with a central aperture cooperates with an upstanding post formed on a base to open or close the closure. The base is affixed to the mouth of a product container, such as a water bottle, and when the cap is moved, such as by twisting or pulling relative to the base, the post on the base is withdrawn from engagement with the aperture in the cap to permit product, such as water, in the container to be dispenses by passing through the aperture. After dispensing of the product is completed, the cap is returned to its closed position by reverse-twisting or pushing on the cap to re-engage the post in the aperture and thereby close the closure and prevent product from being dispensed from the container.

Examples of twist top and pull/push closures of the type referred to above are shown in the following U.S. patents which are owned by the same assignee as the assignee of the present application: U.S. Pat. No. 5,328,063 issued Jul. 12, 1994 entitled "Venting Closure Cap"; U.S. Pat. No. 5,967, 941 issued Nov. 6, 1990 entitled "Twist Lock Adjustable Metering Closure Cap." The disclosures of said two patents which illustrate structure and operational features of examples of twist top and pull/push closures hereby are incorporated herein by reference.

The disclosure of U.S. Pat. No. 5,328,063 shows a pull/push closure in which a cap is mounted on its associated base and the closure is opened/closed by assertion of a pull/push force upon the cap with respect to the base. The disclosure of U.S. Pat. No. 4,967,941 shows a twist type closure in which the cap rides on a ramp formed in the associated base when the cap is twisted with respect to the base of effect the open/close operation of the cap with respect to the base.

In order to facilitate the different types of open/close operations of pull/push-twist closures, the respective bases of the '063 and '941 patents are formed with different constructional elements. In an effort to eliminate the requirement to produce base parts having such different constructional elements, it is desirable to provide a single universal base that can be used interchangeably with either a twist operation cap or a cap which is operational by asserting a pull/push force. Such single universal base construction will afford the advantage of saving the cost of having two different types of bases available for use with a desired twist or pull/pus operational cap.

SUMMARY OF THE INVENTION

The invention is characterized by a universal base provided for use with either a twist operational cap or a cap which is operational on the same base by pull/push operation. The base is formed with helical grooved channels which receive drive threads formed on the inner facing surface of a twist operational cap. When the twist cap is installed on the base, the treads engage the channels and twisting of the cap causes the threads to ride in the channels to effect opening/closing of the closure. The same universal base also is formed with an annular rib positioned on an upstanding post of the base. As an alternative to the twist cap, a pull/push cap is matingly engageable upon the post of the same universal base and includes an inwardly projecting ring which moves along the post between the annular rib and an abutment surface also formed on the post spaced from the rib. Opening/closing of the pull/push cap is effected on the base by pulling on the cap and moving the same on the base so that the inwardly projecting ring rides between the rib and the abutment surface on the base.

Various objects and advantages of the invention will become apparent in accordance with the above and ensuing disclosure in which a preferred embodiment is described in detail in the specification and illustrated in the accompanying drawings. It is contemplated that minor variations may occur to persons skilled in the art without departing from the scope or sacrificing any of the advantages of the invention.

BRIEF DESCRIPTION OF THE DRAWINGS

FIG. 3 is a perspective view of the base and twist cap shown in FIG. 1, the same being assembled together, with portions of the cap shown in phantom outline;

FIG. 4 is a fragmentary sectional view taken along the line 4—4 of FIG. 3, in the direction indicated generally;

FIG. 5 is a sectional view taken along the line 5—5 of FIG. 4, in the direction indicated generally;

FIG. 6 is a sectional view similar to that of FIG. 5, but showing the cap twisted to the phantom outline position illustrated in FIG. 3;

FIG. 7 is a perspective view of the base and pull/push cap shown in FIG. 2, the same being assembled together, with portions of the cap shown in phantom outline; and FIG. 8 is a sectional view taken along the line 8—8 of FIG. 7 in the direction indicated generally.

DESCRIPTION OF THE PREFERRED EMBODIMENTS

Figure 1:
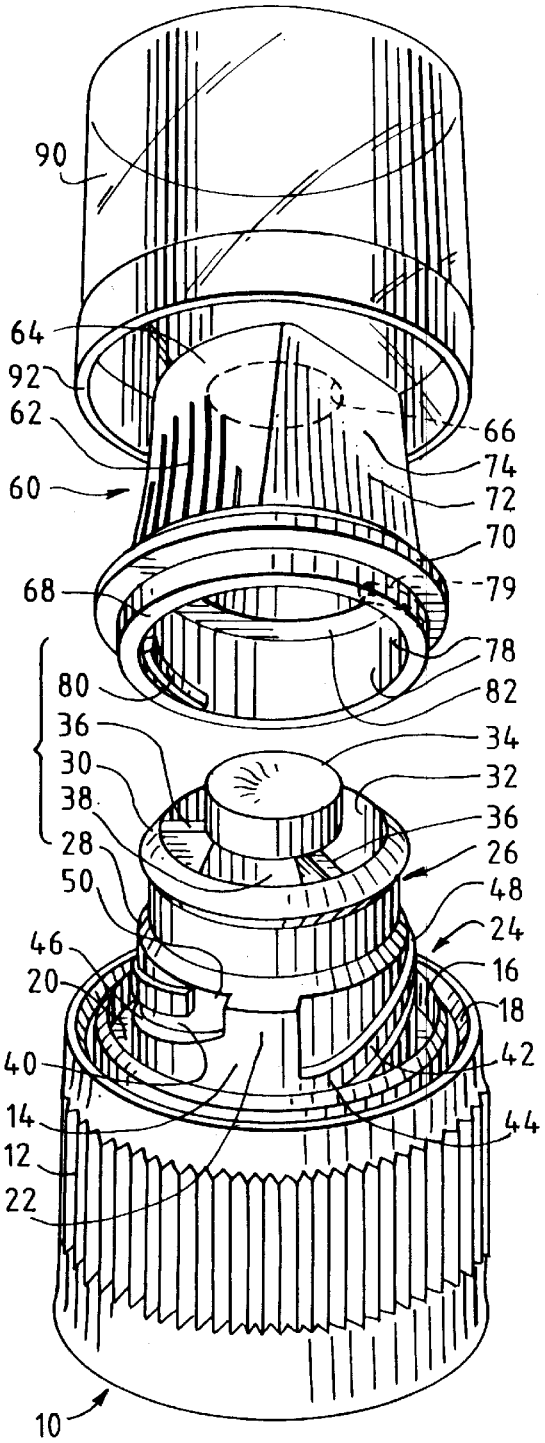
FIG. 1 is an exploded perspective view showing the universal base of the invention with an associated cap operational on the base by twist movement.

Referring to the drawings, the universal base 10 of the invention preferably is formed of molded plastic and includes a body part 12 with an upstanding post 14 formed integral with the body part 12. The base 10 is adapted for attachment to a container top (not shown) in known manner, such as by screw threads (not shown) formed on the inner surface of the body part 12 which mate with like threads on a spout of the container.

The post 14 has a radial dimension which is less than that of body part 12, and concentric channels 16, 18 are formed in body part 12 along the wall 20 which joins post 14 with body part 12. The external surface 22 of post 14 includes a lower portion 24 disposed adjacent to said wall 20, and an upper portion 26 extending above said lower portion 24. The two portions 24, 26 or the post 14 are separated by an abutment surface 28 which extends circumferentially about the post proximate the mid-length of the post 14.

An annular rib 30 is formed proximate to the upper terminal end 32 of upper portion 26 of post 14 and extends circumferentially about he external surface of the post. A closure plug 34 is formed upon the terminal end 32 of the post 14 and is retained thereon by spokes 36 which form passageways 38 between the plug 34 and the interior of base 10 to permit passage of product, such as water, form the container and through base 10 to be dispensed therefrom.

Lower portion 24 of post 14 is formed with a pair of helical grooved channels 40, 42. Each channel 40, 42 is positioned upon post 14 at a location spaced approximately 180° from the other. The channels 40, 42 have respective starting openings 44, 46 located proximate to the wall 20 which joins post 14 with body part 12. Each channel also has a respective terminal opening 48, 50 located proximate to the abutment surface 28 which separates lower and upper portions 24, 26 of post 14. Respective starting openings 44, 46 and terminal openings 48, 50 are spaced from each other upon post 24 at locations which are approximately 180° apart.

Referring to FIGS. 1 and 3–6, universal base 10 is shown in association with twist operational cap 60. Twist cap 60 is formed with an upstanding wall 62 having a top surface 64 with aperture 66 therethrough, and a lower terminal end 68 with circumferentially projecting flange 70 formed proximate thereto. The external surface 72 of cap 60 includes flat formations 74, 76 to facilitate grasping of the cap by a user to effect a twist motion thereto.

The inner surface 78 of cap 60 is adapted for cooperative engagement upon post 14 of body 12, and is formed with a pair of oppositely disposed, radially inwardly projecting drive threads 79, 80. Respective drive threads 79, 80 are positioned at locations which are spaced approximately 180° from each other, and are matingly engageable within respective helical grooved channels 40, 42 formed on post 24.

Twist cap 60 is applied to base 10 initially by pushing the cap over post 14 so that inwardly projecting ring 82 passes below annular rib 30 proximate terminal end 32 of post 14. Next, cap 60 is twisted in the clockwise direction so that respective drive threads 79, 80 enter channels 40, 42 at terminal openings 48, 50. Continual clockwise twisting of cap 60 causes threads 78, 80 to ride in channels 40, 42 and thereby draw the cap downwardly upon post 14 to the closed position of cap 60 shown in solid line in FIGS. 3 and 4. In said closed position, closure plug 34 of post 14 engages within aperture 66 to seal the aperture and prevent dispensing of product therethrough.

Opening of twist cap 60 is accomplished by turning same in the counter-clockwise direction with respect to base 10, thereby causing threads 78, 80 to reverse-ride in channels 40, 42 and move the cap upwardly on post 14 to the opened position shown in phantom outline in FIGS. 3 and 4. Cap 60 is prevented from being disengaged totally from base 10 by engagement of inwardly projecting ring 82 against annular rib 30, which stops the cap from being removable from the base when it is moved to its opened position. When cap 60 is moved to its open position (phantom outline in FIGS. 3 and 4), plug 34 is withdrawn from engagement with aperture 66, and product thereby may be dispensed from the container through the passageways 38 in base 10 and out aperture 66 in cap 60.

When the cap 60 is move to its closed position shown in solid line in FIGS. 3 and 4, terminal end 68 is disposed within channel 16, with flange 70 covering the channel. A removable overcap 90 may be positioned over cap 60 in known manner with terminal edge 92 thereof positioned in channel 18 of base 10.

Figure 2:
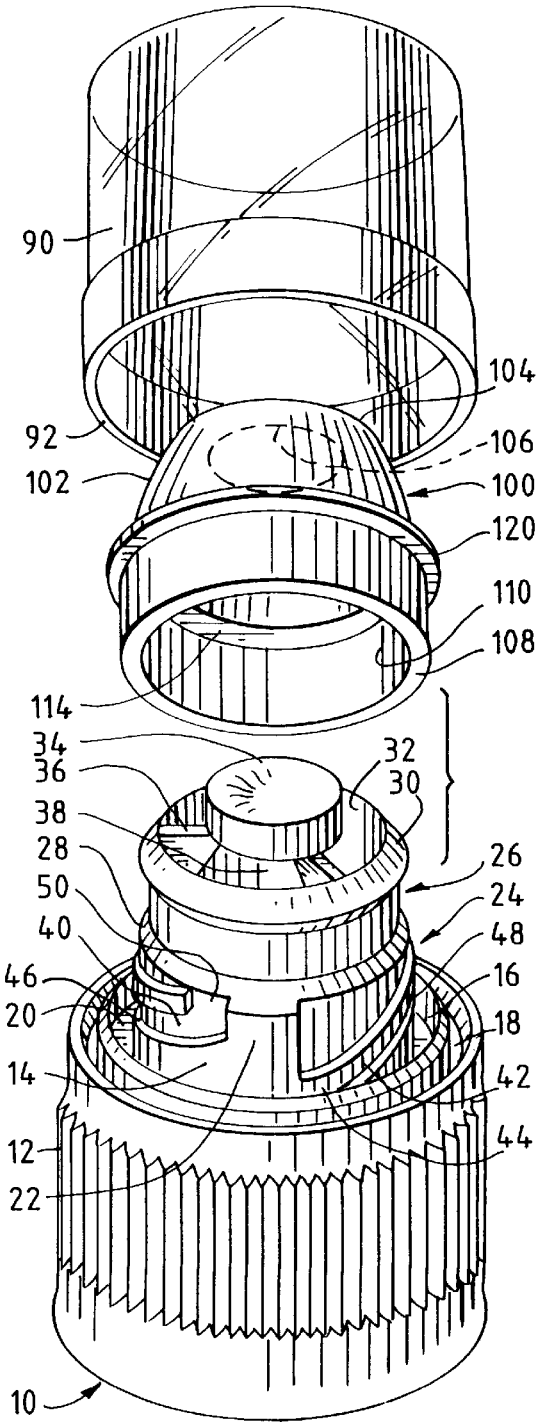
FIG. 2 is an exploded perspective view showing the same universal base of the invention, but with an associated cap operational on the base by pull/push movement.

Referring to FIGS. 2 and 7–8, the same universal base 10 is shown in association with pull/push cap 100. Pull/push cap 100 is formed with an upstanding wall 102 having a top surface 104 with aperture 106 therethrough, and a lower terminal end 108.

The inner surface 110 of cap 100 is adapted for cooperative engagement upon post 14 of body 12, and is formed with an inwardly projecting ring 114 which extends circumferentially about said inner surface 110.

Pull/push cap 100 is applied to base 10 initially by pushing the cap over post 14 so that inwardly projecting ring 114 passes below annular rib 30 proximate terminal end 32 of post 14. Cap 100 thereupon is installed upon base 10 and may be moved between its closed position shown in solid line in FIGS. 7 and 8, and open position shown in phantom outline. When cap 100 is pushed on post 14 to its closed position, closure plug 34 of post 14 engages within aperture 106 to seal the aperture and prevent dispensing of product therethrough. Opening of pull/push cap 100 is accomplished by pulling same with respect to base 10. The pulling operation is facilitated by circumferentially extending ring 120 formed on wall 102 to provide a gripping flange for the user to pull upon. Pulling on cap 100 to its open position causes plug 34 to disengage from aperture 106 and open same to permit dispensing of product from the container and out of the closure.

Cap 100 is prevented from being disengaged totally from base 10 by engagement of inwardly projecting ring 114 against annular rib 30, which stops the cap from being removable from the base when it is moved to its opened position. When cap 100 is pushed to its closed position shown in solid line in FIGS. 7 and 8, terminal end 108 is disposed within channel 16 of base 10. Removable overcap 90 may be positioned over cap 100, as previously described.

As will be clear from the foregoing disclosure, universal base 10 of a single construction is usable with either twist operational cap 60 or pull/push cap 100. When twist cap 60 is used, helical grooved channels 40, 42 cooperate with drive threads 78, 80. When pull/push cap 100 is used, the channels are not employed, but do not interfere with the opening/closing operation of the pull/push cap. Thus, the requirement to produce base parts having different constructional elements for twist and pull/push operational caps is eliminated, with resultant advantages.

Other configurations and variations in the structure, arrangement and size of the various parts may occur to those skilled in the art without department from the spirit or circumventing the scope of the invention as set forth in the appended claims.

What is claimed is:

1. A container closure comprising, a universal base adapted to be positioned on a container and to cooperate interchangeably with a selected twist cap or a pull/push cap having an inner surface installed on said universal base, a twist cap or a pull/push cap engaged upon the base, either of said caps having a top surface, a central aperture passing through the top surface, the base having a central post terminating with a plug which engages the aperture to seal the same when either of said selected caps is positioned on the base at a first closed location thereof, either of said selected caps being movable on the base to a second open location in which the plug is disengaged form the aperture, the post having an external surface with a lower portion and an upper portion extending from said lower portion, said upper and lower portions being separated by an abutment surface extending circumferentially about the post, an annular rib formed on the post proximate the terminal end thereof having aid plug, said annular rib extending circumferentially about the external surface of the post, a pair of helical grooved channels formed on said lower portion, the inner surface of said twist cap including a pair of radially inwardly projecting drive threads matingly engageable with respective ones of said helical grooved channels, the inner surface of said pull/push cap including an inwardly projecting ring, said twist cap being movable on said universal base between said first and second locations by twisting thereof with respect to said base, and said pull/push cap being interchangeable with said twist cap on said universal base and being movable on said universal base between said first and second locations by pulling and/or pushing thereof with respect to said base.

2. A container closure as claimed in claim 1 in which said abutment surface is located proximate to the mid-length of the post.

3. A container closure as claimed in claim 1 in which each channel is positioned on the post at a location spaced approximately 180° from the other.

4. A container closure as claimed in claim 1 in which said twist cap includes an inwardly projecting ring formed on the inner surface thereof, said inwardly projecting ring engaging against said annular rib when said twist cap is moved to said second open location.

5. A container closure as claimed in claim 1 in which said twist cap includes an exterior surface, a circumferentially projecting flange on said exterior surface, said last named flange being disposed adjacent the universal base when the twist cap is moved to said first closed location.

6. A container closure as claimed in claim 5 in which the exterior surface of said twist cap includes flat formations thereon.

7. A container closure as claimed in claim 2 in which the inwardly projecting ring on said pull/push cap engages against said annular rib when said pull/push cap is moved to said second open location.

8. A container closure as claimed in claim 7 in which said pull/push cap includes an exterior wall, a circumferentially extending ring formed on said exterior wall to provide a gripping flange to facilitate pulling thereon.

* * * * *